US005778575A

United States Patent [19]

Deupree et al.

[11] Patent Number: 5,778,575

[45] Date of Patent: Jul. 14, 1998

[54] GARMENT HANGER HOOK SIZE SYSTEM

[75] Inventors: Clifford A. Deupree, Phoenix; Michael W. Dezelon, Paradise Valley; Roy K. Fischer, Scottsdale, all of Ariz.

[73] Assignee: Carlisle Plastics, Inc., North Bergen, N.J.

[21] Appl. No.: 689,972

[22] Filed: Aug. 16, 1996

Related U.S. Application Data

[60] Provisional application No. 60/002,444 Aug. 16, 1995.

[51] Int. Cl.[6] ..... G09F 3/00

[52] U.S. Cl. ..... 40/322; 24/487; 40/666; 223/85

[58] Field of Search ..... 24/487, 543; 40/322, 40/658, 666; 223/85

[56] References Cited

U.S. PATENT DOCUMENTS

| | | | |
|---|---|---|---|
| 3,024,953 | 3/1962 | O'Keefe | 40/322 X |
| 3,448,902 | 6/1969 | Stebbins | 223/85 |
| 3,755,859 | 9/1973 | Solari | 223/85 X |
| 4,115,940 | 9/1978 | Phillips | 40/322 |
| 4,322,902 | 4/1982 | Lenthall | 40/322 |
| 4,333,590 | 6/1982 | Princiotta | 40/322 X |
| 4,416,038 | 11/1983 | Morrone, III | 24/543 X |
| 4,887,324 | 12/1989 | Cairns | 24/487 X |
| 5,096,101 | 3/1992 | Norman et al. | 223/85 |
| 5,388,354 | 2/1995 | Marshall et al. | 40/322 |
| 5,449,099 | 9/1995 | Blanchard | 223/83 |
| 5,503,310 | 4/1996 | Zuckerman et al. | 223/85 |

FOREIGN PATENT DOCUMENTS

| | | | |
|---|---|---|---|
| 2064472 | 6/1981 | United Kingdom | 223/85 |
| 2140679 | 12/1984 | United Kingdom | 223/85 |

*Primary Examiner*—Brian K. Green
*Assistant Examiner*—Andrea Chop
*Attorney, Agent, or Firm*—Kramer, Levin, Naftalis & Frankel

[57] ABSTRACT

A garment hanger with hook adapted to receive a size tab. A portion of the hook includes a formed region or tab receiving web preferably with an opening, and adapted to hold a foldable size tab thereon. The tab receiving web may be formed to protect the edges of the tab thereon. The foldable size tab includes first and second arms which are joined by a living hinge arrangement, preferably molded integrally, which allows the size tab to be molded flat and then folded on the web of the garment hanger to allow attachment of the size tab to the web. The size tab may be formed with three panels joined by a pair of living hinges to provide three viewing surfaces for the sizing indicia or other information.

9 Claims, 5 Drawing Sheets

10
20
21
22
23
24
26
30
32
34
36
38
4
5
7

GARMENT HANGER HOOK SIZE SYSTEM

CROSS REFERENCE TO RELATED PROVISIONAL APPLICATION

This application claims the benefit of U.S. Provisional Application No. 60/002,444 filed on Aug. 16, 1995.

BACKGROUND OF THE INVENTION

The present invention is directed generally to a hook size system for a garment hanger and, in particular, to a new and improved garment hanger hook configuration and associated size tab which can be coupled on the hook in protected fashion and which can include information on three sides thereof.

Garment hanger size systems and constructions are well known in the art. Such systems provide tabs or clips which are coupleable to appropriate portions of the garment hanger. The tabs identify desired information concerning garments hanging on the hanger such as the size of the garment. Norman, et al. U.S. Pat. No. 5,096,101 and Phillips U.S. Pat. No. 4,115,940 depict and describe garment hangers with size indicators that may be positioned on a web located essentially at the base of the hook of the garment hanger above the shoulder portion thereof.

Other patents such as Lenthall U.S. Pat. No. 4,322,902 and Marshall, et al. U.S. Pat. No. 5,388,354 depict and describe garment hangers with size indicators which are coupled on the top of the hook on a specially formed region.

The prior art patents described above provide size tabs which are formed as three dimensional tabs and which include a slot or channel in which the relevant web of the garment hanger extends.

It is extremely desirable to provide size tabs which can be molded or formed in essentially flat condition in which size information can be molded in or printed on after molding, and which is provided on appropriate portions of the garment hanger hook to make viewing of the size information easy and accessible. The present invention provides such a construction.

SUMMARY OF THE INVENTION

Generally speaking, in accordance with the present invention, a garment hanger with hook adapted to receive a size tab, is provided. A portion of the hook includes a specially formed region or tab receiving web, preferably with an opening, and adapted to hold a foldable size tab thereon. The tab receiving web may be formed to protect the edges of the tab thereon.

The foldable size tab includes first and second arms which are joined by a living hinge arrangement, preferably molded integrally, which allows the size tab to be molded flat and then folded on the special web on the garment hanger to allow attachment of the size tab to the web.

In a preferred embodiment, the size tab is formed with three panels joined by a pair of living hinges. When folded, the size tab provides a front face, a back face and an intermediate face therebetween. Size information can be printed or formed on or applied to all three faces to permit viewing of the size information from many orientations.

The size tab may also be formed with opposing latches on the outer faces which will engage through an opening on the garment hanger web to allow the size tab to be locked on the hook.

Accordingly, it is an object of the present invention to provide an improved garment hanger size tab system.

Another object of the present invention is to provide a garment hanger with hook having a specially formed region adapted to receive a foldable size tab.

Yet another object of the present invention is to provide a size tab which can be molded or formed in flat condition and then folded to provide a three dimensional size tab.

Still another object of the present invention is to provide an improved garment hanger size system in which information can be printed or formed on the size tab while flat, and then when folded will display the information on various sides of the garment hanger hook.

Still other objects and advantages of the invention will in part be obvious and will in part be apparent from the specification.

The invention accordingly comprises an article of manufacture possessing the features, properties, and the relation of elements which will be exemplified in the constructions hereinafter described.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figures 1, 3, 4:
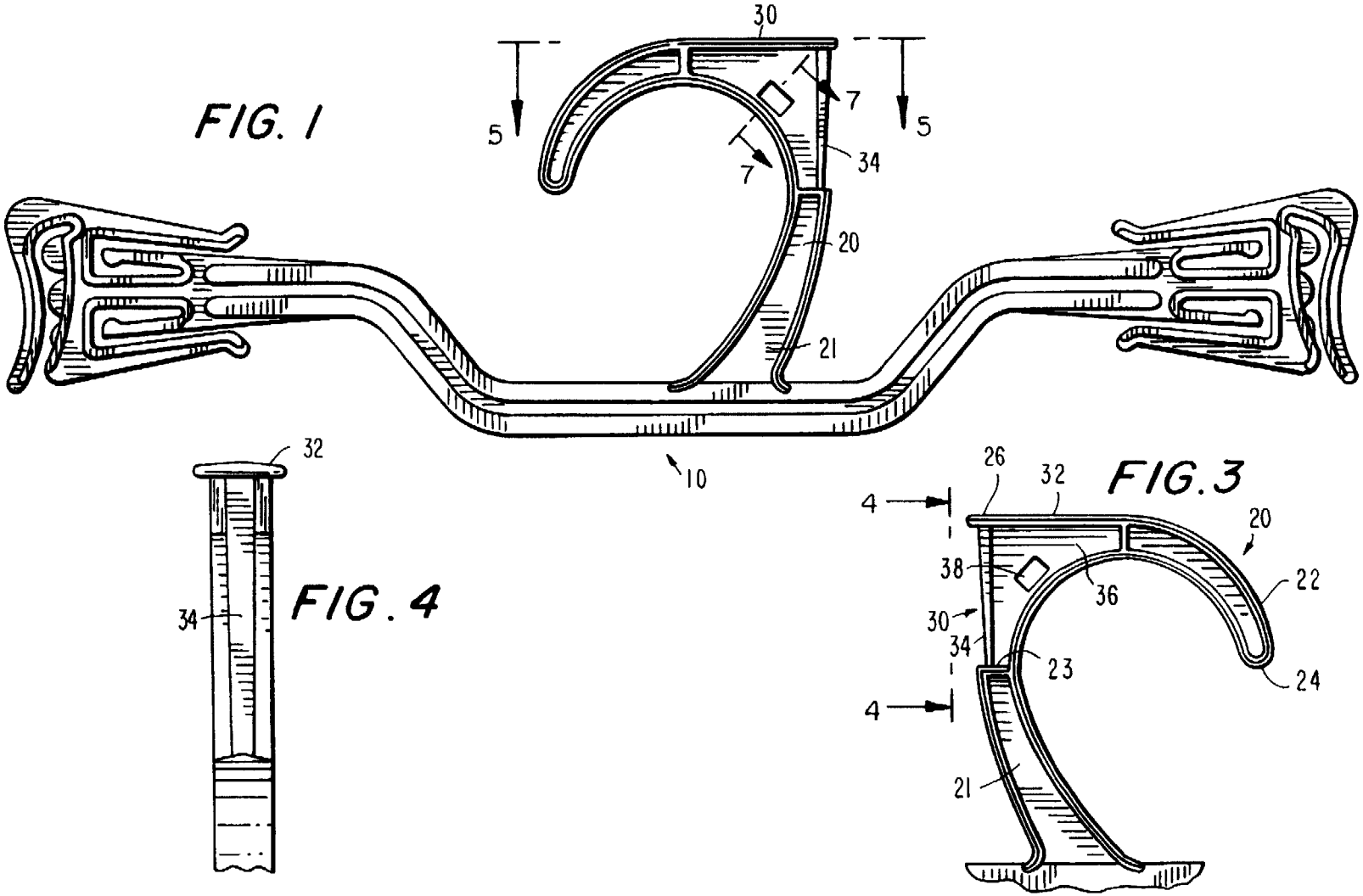
FIG. 1 is a front elevational view of a garment hanger incorporating a garment hook size system in accordance with a preferred embodiment of the present invention.
FIG. 3 is an enlarged elevational view of the hook portion of the garment hanger.
FIG. 4 is an enlarged plan view of the front face of the hook web depicted in FIG. 1.

Reference is first to FIGS. 1 through 7 which depict a garment hanger, generally indicated at 10, having a hook 20. Garment hanger 10 is preferably molded from a thermoplastic material such as a polypropylene, polystyrene or the like, although other materials may be used as is known in the art.

Hook 20 is used to suspend garment hanger 10 from an appropriate support or rod such as a closet rod or the like. Hook 20 includes a top front curved section 22 having a free end 24 and a top rear section 26 on which a size tab web 30 is formed. The front free end 24 of the hook generally is of an I-beam construction as depicted. Hook portion 21 below size web 30 is also of a similar I-beam construction, as depicted, and includes a top rail 23.

Figures 2, 5, 6, 7:
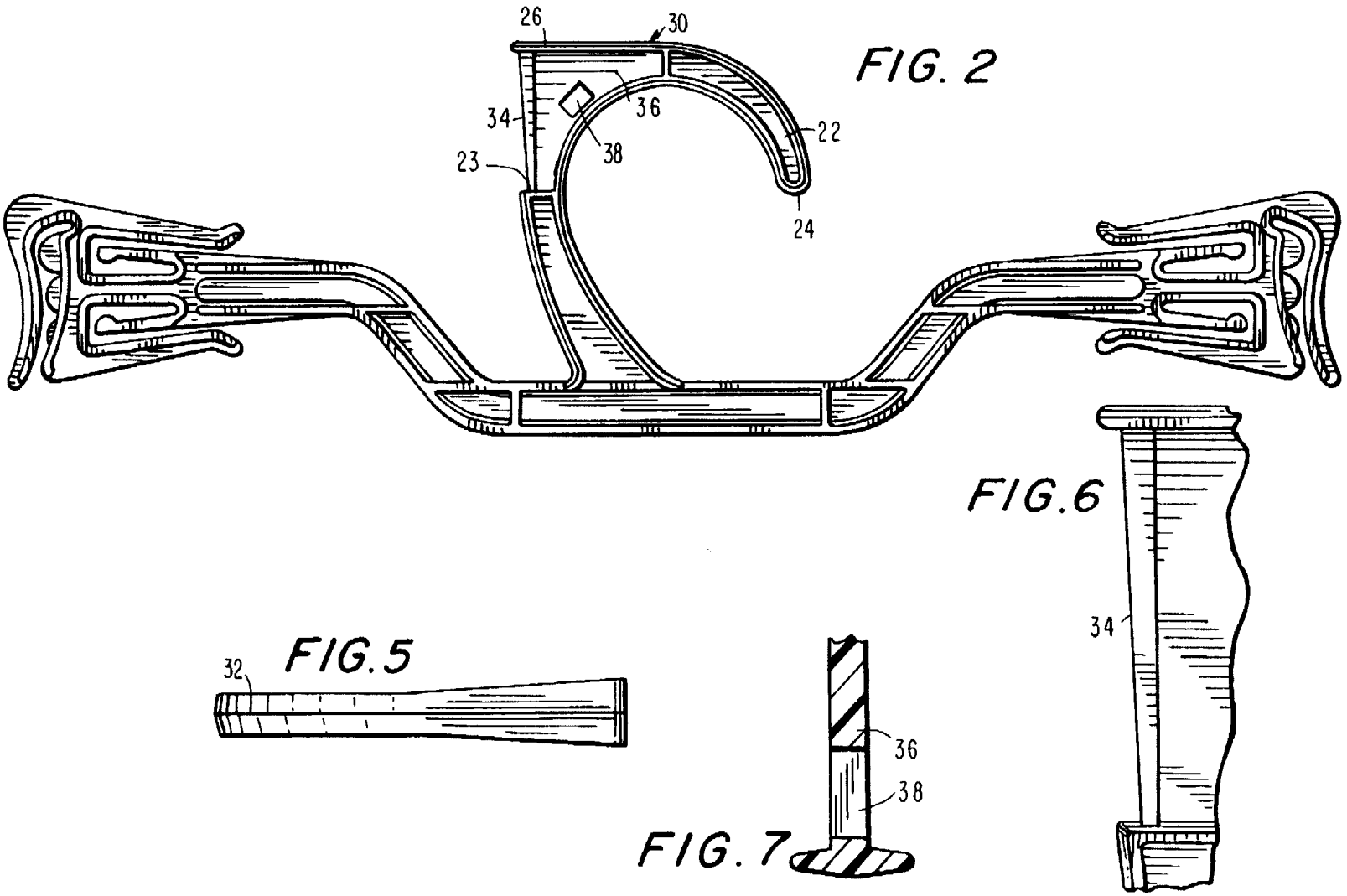
FIG. 2 is a rear elevational view of the garment hanger depicted in FIG. 1.
FIG. 5 is a top plan view of the hook web depicted in FIG. 1.
FIG. 6 is an enlarged view of the sidewall of the hook web depicted in FIG. 2.
FIG. 7 is a sectional view taken along line A—A of FIG. 1.
Figure 9:
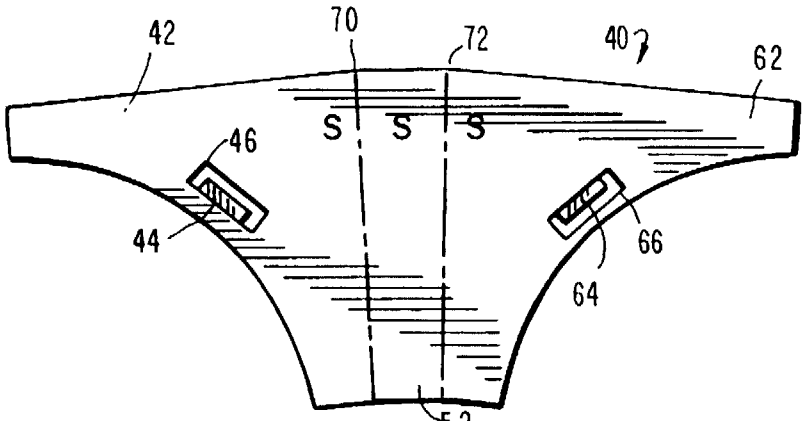
FIG. 9 is a rear elevational view of the size tab depicted in FIG. 8.
Figure 8:
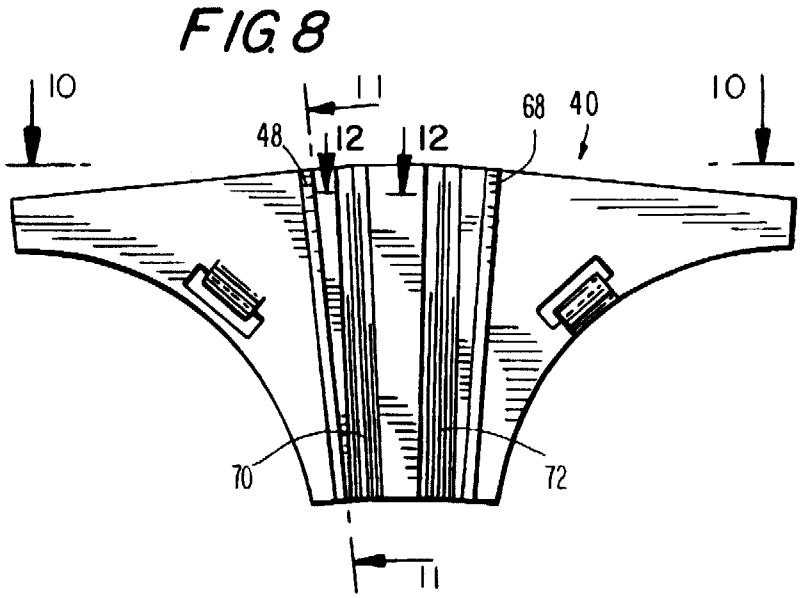
FIG. 8 is a front elevational view of a size tab constructed in accordance with a preferred embodiment of the present invention for use in conjunction with the garment hanger hook size web depicted in FIGS. 1 through 7.
Figure 10:
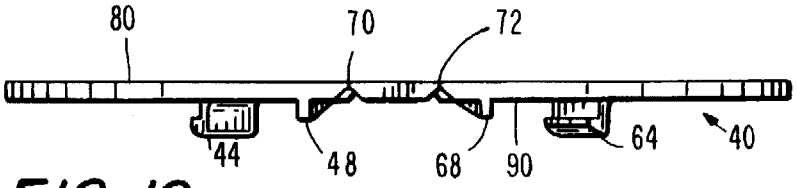
FIG. 10 is a top plan view of the size tab depicted in FIG. 10.
Figure 12:
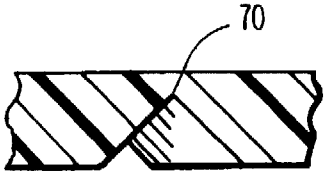
FIG. 12 is a detailed side view of one of the living hinges depicted in FIG. 10.
Figure 11:
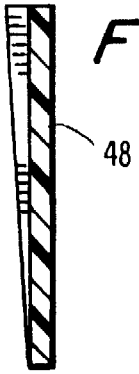
FIG. 11 is a sectional view taken along line D—D of FIG. 8.

Size web 30 includes a top wall 32, the side edges of which diverge from one another towards the rear thereof as best depicted in FIG. 5. Back wall 34 also includes sloping side walls as best depicted in FIG. 4. Internal web face 36 is flat and includes an opening 38, the purpose of which will be described below.

Referring now additionally to FIGS. 8 through 12, a size tab in accordance with the invention is generally indicated at 40. Size tab 40 is molded from a plastic material in flat open condition as depicted. Tab 40 is preferably formed with three faces or panels 42, 52 and 62. Intermediate panel 52 is generally rectangular in shape as depicted whereas panels 42 and 62 are essentially mirror images of one another and are generally triangular or wing-shaped panels. The panels are joined or molded together preferably by living hinges 70 and 72.

Tab 40 includes a top surface 80 and a bottom surface 90. Top surface 80 is generally flat when tab 40 is formed. A latch 44 extends from bottom surface 90 of panel 42 and a corresponding latch 64 extends from bottom surface 90 of panel 62. The formation of latches 44 and 64 during the molding process produces openings 46 and 66 in panels 42 and 62, respectively.

Latches 44 and 64 are positioned such that when the bottom surface 90 of panels 42 and 62 are brought towards one another by bending about living hinges 70 and 72, latches 44 and 64 will couple to hold size tab 40 in folded condition.

Referring again additionally to FIGS. 1 through 7, it is seen that size tab 40 may be positioned over web 30 and then folded such that latches 44 and 64 can lock through opening 38 to hold size tab 40 on web 30. When this is done, the size tab will present a front face 42, a rear face 62 and an intermediate face 52, each of which can have size information or other information preformed or preprinted thereon to allow viewing of the size information from the front of the hanger, from the rear of the hanger and from the side of the hanger which faces outwardly when the hook is supported on a rod or the like. By allowing for graphics or other information on all three sides of the tab, the size information becomes very visible and therefore desirable.

It is noted that bottom surface 90 of panels 42 and 62 include elongated projections 48 and 68, respectively, which are captured behind side wall 34 of web 30 thereby providing further securement of tab 40 on panel 30. Indeed, web 30 is formed such that top wall 26 extends over the top edge of tab 40. Also, the internal I-beam portion of the hook forming the bottom of the web covers the free curved edges of size tab 40. Likewise, the bottom free edge of the size tab is covered by the top I-beam rail 23 construction on lower portion 21 of the hook. Thus, tab 40, when locked on web 30, appears to be recessed and is protected on its side edges to prevent inadvertent dislodgement thereof.

Because the side edges of the tab are protected by the relevant border portions of the garment hanger web, the tab is securely coupled to the web. The internal latching system is also generally inaccessible except through the reduced size openings. The locking power can be controlled by forming the overlapping portions of the latches in desired configurations.

Figure 13:
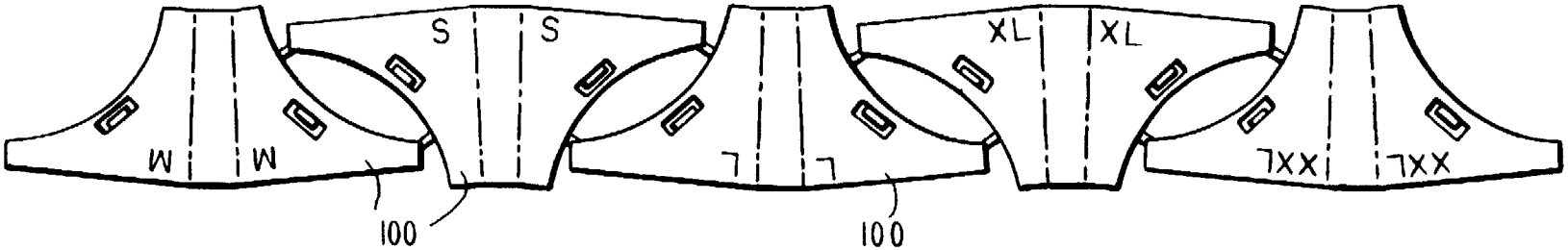
FIG. 13 is a plan view depicting a plurality of size tabs of the present invention shown molded flat.
Figure 14:
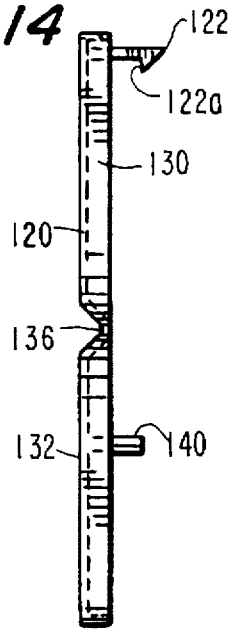
FIG. 14 is a side elevational view of a size tab constructed in accordance with an alternative embodiment of the present invention.
Figure 15:
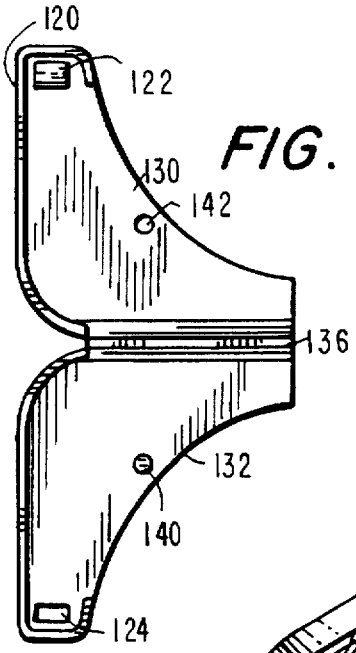
FIG. 15 is a bottom plan view of the size tab depicted in FIG. 14.
Figure 16:
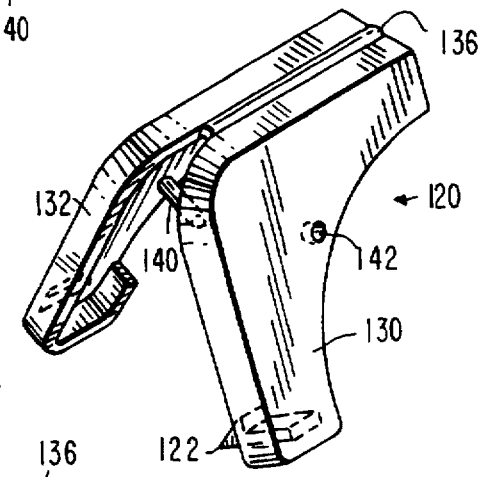
FIG. 16 is a perspective view of the size tab depicted in FIG. 14 shown in partially folded condition.
Figure 17:
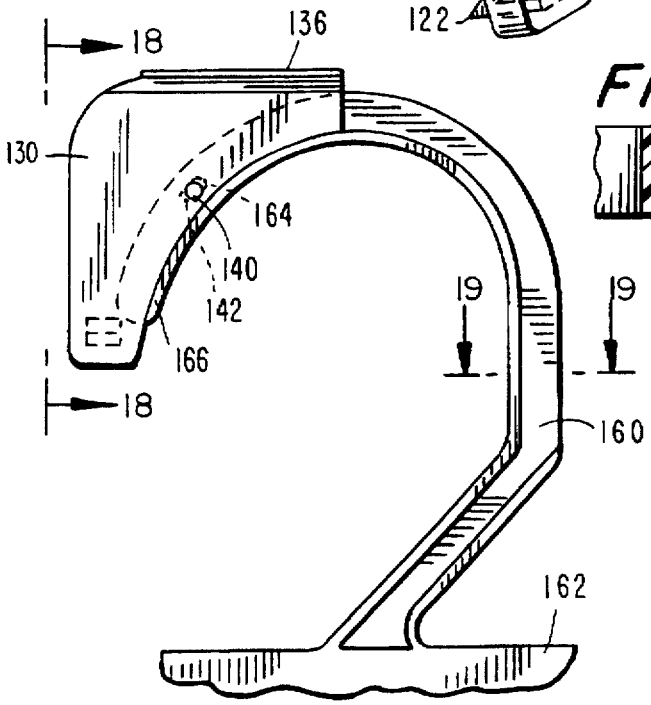
FIG. 17 is a front elevational view of the hook portion of a garment hanger showing the size tab of FIG. 14 in position thereon.

FIG. 13 depicts a plurality of size tabs 100 showing that such tabs can be molded flat in sequence and then broken apart.

Reference is now made to FIGS. 14 through 19 which depict an alternative embodiment of the present invention. Tab 120 includes a latch 122 on a first panel 130 with an undercut 122*a* and a corresponding opening 124 on the second panel 132 thereof on the other side of living or moving hinge 136. Second panel 132 also includes a post 140 and first panel 130 includes a corresponding opening 142.

Figure 18:
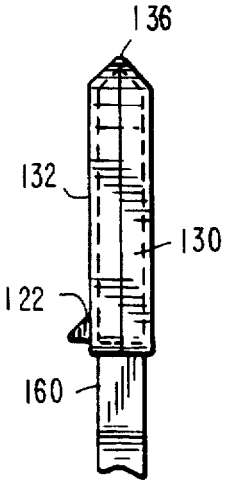
FIG. 18 is a side view taken along line 18—18 of FIG. 17.
Figure 19:
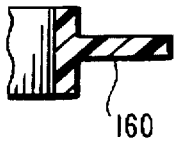
FIG. 19 is an enlarged sectional view taken along line 19—19 of FIG. 17.

Hook 160 of garment hanger 162 is of conventional form and has the usual I-beam construction as depicted in FIG. 19. An opening 164 is provided on the forward end 166 of hook 160 which allows post 140 to extend therethrough so that size tab 120 can be coupled to forward end 166 of hook 160 and releaseably secured thereto. When positioned and locked on hook 160, latch 122 will engage through opening 124 as best depicted in FIG. 18 to hold panels 130 and 132 together, and post 140 will extend through opening 164 in hook 160 and will be captured in opening 142 on panel 130.

As in the embodiments described above, size tab 120 may be molded in flat condition with appropriate sizing indicia or other information printed or formed on the outer visible surfaces of panels 130 and 132.

The present invention provides a hook sizing system for garment hangers where the size tabs may be molded in flat condition and then folded to lock or join on the hook. The constructions provide a neat, simple to use and highly desirable sizing system.

It will thus be seen that the objects set forth above, among those made apparent from the preceding description, are efficiently attained and, since certain changes may be made in the above constructions without departing from the spirit and scope of the invention, it is intended that all matter contained in the above description are shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A garment hanger sizing system comprising a garment hanger having a hook with a tops said hook having a forward free end and a rear end, said rear end being formed with a size tab region adjacent the top of said hook, a size tab securable on said size tab region, said size tab having first and second panels joined by a living hinge, said size tab being securable on said size tab region by folding said first and second panels thereover, and a locking mechanism for locking said first panel to said second panel over said size tab region said size tab region including a top surface, a bottom surface and an inner rounded surface, all of which form a border around said size tab when positioned on said size tab region, said size tab region including a flattened panel, said flattened panel including an opening therethrough, said locking mechanism on said size tab extending through said opening when said size tab is secured on said size tab region, said flattened panel including an outer side wall having a raised edge, said size tab including projections on the inner surface thereof which capture said raised edge to hold said size tab on said size tab region.

2. The garment hanger sizing system as claimed in claim 1, wherein said size tab includes an intermediate panel coupled intermediate said first and second panels by a pair of opposing living hinges on opposite sides thereof.

3. The garment hanger sizing system as claimed in claim 2, wherein each of said first, second and intermediate panels have indicia printed thereon.

4. The garment hanger sizing system as claimed in claim 3, wherein said size tab is molded flat and then folded onto said size tab region to provide a three dimensional size tab.

5. A size tab for a garment hanger having a web for receiving said size tab, said size tab comprising first and second panels joined by a living hinge, said first and second panels each having an inner surface, said size tab being form in flat open condition, said size tab being folded about said living hinge to be secured to said web, said size tab including a locking mechanism to lock said size tab on said web, said locking mechanism locking said first panel to said second panel about said web, further comprising an intermediate panel disposed between said first and second panels and coupled thereto by respective living hinges, said locking mechanism including corresponding latches found on the inner surface of said first and second panels, indicia being formed on said first, second and intermediate panels.

6. A garment hanger sizing system comprising a garment hanger having a hook, said hook having a forward free end, said free end being formed with a size tab region, a size tab securable on said size tab region, said size tab having first and second panels joined by a living hinge, said size tab being securable on said size tab region by folding said first and second panels thereover, and a locking mechanism for locking said first panel to said second panel over said size tab region.

7. The garment hanger sizing system as claimed in claim 6, wherein said forward free end of said hook includes an opening therethrough, said first panel of said size tab including a post which extends through said opening.

8. The garment hanger sizing system as claimed in claim 7, wherein said locking mechanism includes a latch on said first panel and a corresponding opening in said second panel.

9. The garment hanger sizing system as claimed in claim 8, wherein said second panel includes an opening corresponding to the post on said first panel.

* * * * *